US005095002A

United States Patent [19]

Beck et al.

[11] Patent Number: 5,095,002

[45] Date of Patent: Mar. 10, 1992

[54] THERMAL TRANSFER RECEIVER

[75] Inventors: Nicholas C. Beck, Brantham; Paul A. Edwards, Dovercourt; Richard A. Hann, Ipswich, all of England

[73] Assignee: Imperial Chemical Industries PLC, London, England

[21] Appl. No.: 556,075

[22] Filed: Jul. 23, 1990

[30] Foreign Application Priority Data

Jul. 21, 1989 [GB] United Kingdom ..... 8916723
Nov. 9, 1989 [GB] United Kingdom ..... 8925281
May 11, 1990 [GB] United Kingdom ..... 9010608

[51] Int. Cl.[5] ..... B41M 5/035; B41M 5/26

[52] U.S. Cl. ..... 503/227; 8/471; 428/195; 428/447; 428/913; 428/914

[58] Field of Search ..... 8/471; 428/195, 447, 428/913, 914; 503/227

[56] References Cited

U.S. PATENT DOCUMENTS 4,992,413 2/1991 Egashira et al. ..... 503/227

*Primary Examiner*—Bruce H. Hess
*Attorney, Agent, or Firm*—Cushman, Darby & Cushman

[57] ABSTRACT

A receiver sheet for dye-diffusion thermal transfer printing comprises a sheet-like substrate supporting a receiver coat layer in which a dye-receptive polymer composition is doped with a release system comprising the reaction product of at least one silicone having a plurality of hydroxy groups per molecule and at least one polyfunctional N-(alkoxymethyl) amine resin reactive with such hydroxyl groups under acid catalyzed conditions.

10 Claims, 1 Drawing Sheet

THERMAL TRANSFER RECEIVER

Figure 1:
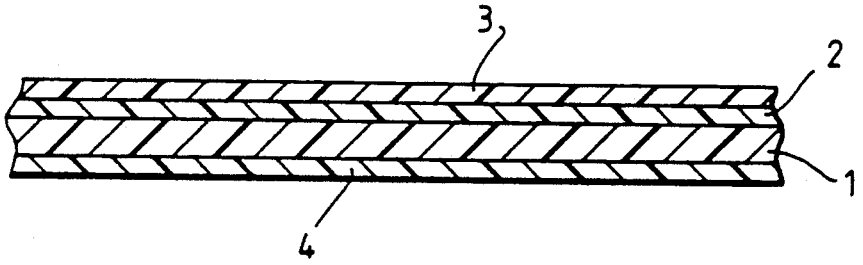

The invention relates to thermal transfer printing, and especially to receiver sheets of novel construction and their use in dye-diffusion thermal transfer printing.

Thermal transfer printing ("TTP") is a generic term for processes in which one or more thermally transferable dyes are caused to transfer from a dyesheet to a receiver in response to thermal stimuli. For many years, sublimation TTP has been used for printing woven and knitted textiles, and various other rough or intersticed materials, by placing over the material to be printed a sheet carrying the desired pattern in the form of sublimable dyes. These were then sublimed onto the surface of the material and into its interstices, by applying heat and gentle pressure over the whole area, typically using a plate heated to 180°-220° C. for a period of 30-120 s, to transfer substantially all of the dye.

A more recent TTP process is one in which prints can be obtained on relatively smooth and coherent receiver surfaces using pixel printing equipment, such as a programmable thermal print head or laser printer, controlled by electronic signals derived from a video, computer, electronic still camera, or similar signal generating apparatus. Instead of having the pattern already preformed on the dyesheet, a dyesheet for this process comprises a thin substrate supporting a dyecoat comprising a single dye or dye mixture (usually dispersed or dissolved in a binder) forming a continuous and uniform layer over an entire printing area of the dyesheet. Printing is effected by heating selected discrete areas of the dyesheet while the dyecoat is held against a dye-receptive surface, causing dye to transfer to the corresponding areas of the receptive surface. The shape of the pattern transferred is thus determined by the number and location of the discrete areas which are subjected to heating, and the depth of shade in any discrete area is determined by the period of time for which it is heated and the temperature reached. The transfer mechanism appears to be one of diffusion into the dye-receptive surface, and such a printing process has been referred to as dye-diffusion thermal transfer printing.

This process can give a monochrome print in a colour determined by the dye or dye-mixture used, but full colour prints can also be produced by printing with different coloured dyecoats sequentially in like manner. The latter may conveniently be provided as discrete uniform print-size areas, in a repeated sequence along the same dyesheet.

A typical receiver sheet comprises a sheet-like substrate supporting a receiver coat of a dye-receptive composition containing a material having an affinity for the dye molecules, and into which they can readily diffuse when the adjacent area of dyesheet is heated during printing. Such receiver coats are typically around 2-6 μm thick, and examples of suitable dye-receptive materials include saturated polyesters, preferably soluble in common solvents to enable them readily to be applied to the substrate as coating compositions and then dried to form the receiver coat.

Various sheet-like materials have been suggested for the substrate, including for example, cellulose fibre paper, thermoplastic films such as biaxially orientated polyethyleneterephthalate film, plastic films voided to give them paper-like handling qualities (hence generally referred to as "synthetic paper"), and laminates of two or more such sheets.

High resolution prints can be produced by dye-diffusion thermal transfer printing using appropriate printing equipment, such as the programmable thermal print head referred to above. A typical thermal print head has a row of tiny heaters which print six or more pixels per millimeter, generally with two heaters per pixel. The greater the density of pixels, the greater is the potential resolution, but as presently available printers can only print one row at a time, it is desirable to print them at high speed with short hot pulses, usually from near zero up to about 10 ms long, but even up to 15 ms in some printers, with each pixel temperature typically rising to about 350° C. during the longest pulses.

Typical dye-receptive compositions are thermoplastic polymers with softening temperatures below the temperatures used during printing. Although the printing pulses are so short, they can be sufficient to cause a degree of melt bonding between the dyecoat and receptive layer, the result being total transfer to the receiver of whole areas of the dyecoat. The amount can vary from just a few pixels wide, to the two sheets being welded together over the whole print area.

To overcome such total transfer problems arising during printing, there have been various proposals for adding release agents, either as a coating over the receiver coat or in the receiver coat itself. Particularly effective release systems include silicones and a cross-linking agent, which can be incorporated into the receiver coating composition containing the dye-receptive material, and cross linking effected after the composition has been coated onto the substrate to form the receiver coat. This cross-linking stabilises the coat and prevents the silicone migrating. However, although they can provide excellent release when incorporated in this way, some silicone systems can also cause development of unwanted side effects. Among these side effects, we found that a receiver coat having an improved release from the dyesheet during printing, may similarly have poorer adhesion to the underlying surface onto which it was coated, and this could lead to problems. Some have been found adversely to affect the achievable optical density of prints produced in the manner, and other problems can arise from incompatibility of the silicone with many thermal transfer dyes, leading to unstable prints in which the received dye molecules tend to migrate through the receiver coat and crystallise on the surface.

We have now developed a new receiver coat composition using an acid catalysed release system, which we find can give a particularly good balance of optical density, print stability, coating ability and release properties. It also enables us readily to adapt the receiver sheet as a whole to provide improved handling characteristics and/or to obtain good adhesion between receiver coat and substrate, where these are critical.

According to a first aspect of the present invention, a receiver sheet for dye-diffusion thermal transfer printing comprises a sheet-like substrate supporting a receiver coat consisting essentially of a dye-receptive polymer composition doped with a release system, characterised in that the release system comprises a thermoset reaction product of at least one silicone having a plurality of hydroxyl groups per molecule and at least one organic polyfunctional N-(alkoxymethyl) amine resin reactive with such hydroxyl groups under acid catalysed conditions.

The silicones can be either branched or linear, although the latter may give better flow properties, which can be helpful during the substrate coating process. The hydroxyl groups can be provided by copolymerising a silicone moeity with a polyoxyalkylene to provide a polymer having molecules with terminal hydroxyls, these being available for reaction with the amine resins. A difunctional example of such silicone copolymers is polydimethylsiloxane polyoxyalkylene copolymer. These have linear molecules with two terminal hydroxyls per molecule, and to obtain the multiple cross-linking of a thermoset product, they require an N-(alkoxymethyl) amine resin having a functionality of at least 3, i.e. its polyfunctionality is provided by its having at least three alkoxymethyl groups per molecule which are available to react with the hydroxyl groups. Hydroxyorgano functional groups can also be grafted directly onto the silicone backbone to produce a cross-linkable silicone suitable for the composition of the present invention. Examples of these include Tegomer HSi 2210, which is a bis-hydroxyalkyl polydimethylsiloxane. Again having a functionality of only 2, a cross-liking agent having a greater functionality is required to achieve a thermoset result.

Preferred polyfunctional N-(alkoxymethyl) amine resins include alkoxymethyl derivatives of urea, guanamine and melamine resins. Lower alkyl compounds (i.e. up to the $C_4$ butoxy derivatives) are available commercially and all can be used effectively, but the methoxy derivative is much preferred because of the greater ease with which its more volatile by-product (methanol) can be removed afterwards. Examples of the latter which are sold by American Cyanamid in different grades under the trade name Cymel, are the hexamethoxymethylmelamines, suitably used in a partially prepolymerised (oligomer) form to obtain appropriate viscosities. Hexamethoxymethylmelamines are 3–6 functional, depending on the steric hindrance from substituents and are capable of forming highly cross-linked materials using suitable acid catalysts, e.g. p-toluene sulphonic acid (PTSA). However, the acids are preferably blocked when first added, to extend the shelf life of the coating composition, examples include amine-blocked PTSA (e.g. Nacure 2530) and ammonium tosylate.

Preferred receiver coats contain only the minimum quantity of the silicone that is effective in eliminating total transfer. This varies with the silicone selected for use. Some can be effective below 0.2%, with a practical minimum for the best of those so far tried, seeming to be about 0.16% by weight of the dye-receptive polymer. Silicone quantities as high as 5% by weight of the polymer may start to show the instability problems referred to above, and less than 2% is generally to be preferred.

We find that any free silicone may lead to total transfer problems, and prefer to use at least an equivalent amount of the amine resin. We prefer that any excess of the resin be small, and find a quantity of resin within the range 1–2 equivalents of the silicone, will generally be suitable.

The release system is cured after the polyfunctional silicone and cross-linking agent have been added to the dye-receptive polymer composition, the catalyst mixed in and the mixture applied as a coating onto the substrate or any undercoat that may previously have been applied to it.

The dye-receptive polymer forms the bulk of the receiver coat composition. This may comprise a single species of polymer, or may be a mixture. Particularly dye-receptive organic polymers are the saturated polyesters. Examples of these which are commercially available include Vitel PE 200 (Goodyear), and Vylon polyesters (Toyobo), especially grades 103 and 200. Of these the different grades of saturated polyesters, from the same manufacturer at least, are generally compatible, and can be mixed to provide a composition of the desired Tg (the manufacturers quoting the Tg values of Vylon 103 and 200 as 47° and 67° C. respectively, ±4° C.). For higher overall Tgs, Vylon 290 (Tg 77° C. ±4° C.) may be used alone or in combination with the others.

The organic polymer composition may also usefully contain other polymers, such as polyvinyl chloridepolyvinyl alcohol copolymer, for example.

Various sheet-like materials have been suggested for the substrate, including for example, cellulose fibre paper, thermoplastic films such as biaxially orientated polyethyleneterephthalate film, plastic films voided to give them paper-like handling qualities (hence generally referred to as "synthetic paper"), and laminates of two or more such sheets.

With most paper-based substrates that do not themselves tend to hold surface charges of static electricity, the provision of so thin a coating of organic polymer does not usually lead to static-induced problems. However, receiver sheets based on thermoplastic films, synthetic papers and some cellulosic papers that are dielectric materials, readily build up charges of static electricity on their exposed surfaces, unless provided with some antistatic treatment. This in turn leads to poor handling properties generally, and especially when stored in packs of unused receiver sheets and stacks of prints made from them, i.e. when individual sheets may be moved relative to adjacent sheets with which they are in contact. Such sheets tend to stick together rather than slide easily one sheet over another.

This problem can be alleviated by providing both sides of the receiver sheet with an antistatic treatment. However, when a receptive layer contains both antistatic and anti-total-transfer release additives, these may compete for the exposed surface, such that when the layer has sufficient antistatic agent to remove the static problem, total transfer is no longer prevented; and when total transfer is avoided, the handling tends to suffer.

To avoid this problem of surface competition, we prefer to use a receiver sheet in which the antistatic treatment on the receptor side comprises a conductive undercoat located between the substrate and the receiver coat.

A particularly effective conductive undercoat comprises a cross-linked organic polymer containing a plurality of ether linkages doped with an alkali metal salt to provide conductivity. Lithium salts of organic acids are particularly suitable. These may be used in small quantities, e.g. corresponding to the number of ether linkages available for coordination to the lithium. A suitable organic polymer is one comprising a compound containing per molecule at least one ether linkage to which the metal ions become coordinated, the molecules being cross-linked by a polyfunctional compound reactive with the ether-containing compound other than through its ether linkage. Particularly suitable are acid catalysed reaction products of polyalkylene glycols with a polyfunctional cross-linking agent reactive with the terminal hydroxyls of the polyalkylene glycols.

Preferred crosslinking agents include polyfunctional N-(alkoxymethyl) amine resins, including the alkoxymethyl derivatives of urea, guanamine and melamine resins described above for use in the receiver coat, e.g. Cymel hexamethoxymethylmelamines. Indeed, we particularly prefer that the cross-linking agent used in the conductive undercoat be essentially the same as that of the receptive layer. By "essentially the same" we have in mind that a different grade of Cymel may be desirable to adjust the viscosity during coating, for example, while retaining essentially the same chemical characteristics.

Using an undercoat that is acid catalysed like the receiver coat, leads to compatibility between the two layers, and we find that even though curing of the conductive undercoat should be complete before the receiver layer is superimposed, we obtain a stronger bond between them than when we use silicone release agents cross-linked under different, less compatible, conditions.

When used in suitable thicknesses, e.g. 1 μm, conducting undercoats can be made transparent and substantially colourless, and thus be suitable for use in transparencies for overhead projection, for example, in addition to normal prints such as those viewed by reflected light.

Various other layers of applied coatings may also be present. For example, the substrate may be provided with an adhesive subbing layer, this being common practice in some film coating applications. However, we find that a conducting undercoat with compatible curing conditions as described above, itself provides a usefully strong bond between the receiver coat and substrate, even when used directly in contact with the substrate without any of the normal subbing layers being present. Indeed, where good adhesion between the present receiver layer and the substrate is the prime consideration and a conducting layer is not required, this adhesion can be achieved simply by first applying to the bare substrate a compatible undercoat substantially as the conductive undercoat composition without the antistatic agent, or as the receiver coat composition with the silicone replaced by an organic compound of corresponding functionality.

Receiver sheets may also have at least one backcoat on the side of the substrate remote from the receiver coat. Backcoats may provide a balance for the receiver coat, to reduce curl during temperature or humidity changes. They can also have several specific functions, including improvements in handling characteristics by making them conducting (the combination of a conducting backcoat and a conducting undercoat on the receiver side of the substrate being particularly effective), and by filling them with inert particles enabling the back of the print to be written upon.

Receiver sheets according to the first aspect of the invention can be sold and used in the configuration of long strips packaged in a cassette, or cut into individual print size portions, or otherwise adapted to suit the requirements of whatever printer they are to be used with (whether or not this incorporates a thermal print head or alternative printing system), to take full advantage of the properties provided hereby.

According to a second aspect of the invention, we provide a stack of print size portions of a receiver sheet according to the first aspect of the invention, packaged for use in a thermal transfer printer. Such stacks provide a supply of receiver sheets having both release and stability advantages during and after printing, as described above. When the receiver coat is applied over a conductive layer, the sheets may be fed individually from the stack to a printing station in a printer, unhindered by static-induced blocking. There is also less risk of dust pick-up.

Figure 2:
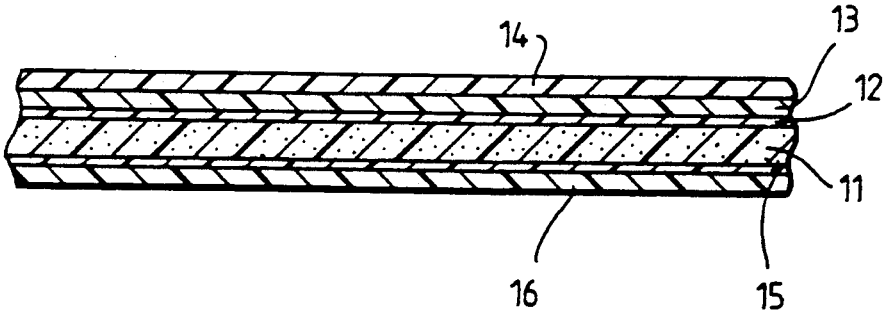

The invention is illustrated by reference to specific embodiments shown in the accompanying drawings, in which:

FIG. 1 is a diagrammatical representation of a cross section through a receiver according to the present invention, and FIG. 2 is a diagrammatical representation of a cross section through a second receiver according to the present invention.

The receiver sheet shown in FIG. 1 has a substrate of biaxially orientated polyethyleneterephthalate film 1. Coated onto one side of this is a conducting undercoat 2 of the present invention, overlain by a receiver coat 3. On the reverse side is an antistatic backcoat 4.

The receiver sheet shown in FIG. 2 uses synthetic paper 11 for the substrate. This has a subbing layer 12, conducting undercoat 13, and receiver coat 14, and on the reverse side is a further subbing layer 15 and a backcoat 16.

EXAMPLE 1

To illustrate further the present invention, receiver sheets were prepared essentially as shown in FIG. 1. A large web of transparent biaxially orientated polyester film was provided on one side with a conducting undercoat overlayed with a receiver coat, and with a conducting backcoat on the other, as described below.

The first coat to be applied to the web was the backcoat. One surface of the web was first chemically etched to give a mechanical key. A coating composition was prepared as follows:

| | | |
|---|---|---|
| acetone/ diacetone alcohol | 11/1 | mixed solvent with trace of isopropanol |
| VROH | 42 | parts by weight |
| Cymel 303 | 15 | " |
| Nacure 2530 | 10 | " |
| $LiNO_3$ | 1 | " |
| Diakon MG102 | 22 | " |
| Gasil EBN | 2 | " |
| Syloid 244 | 8 | " |

(VROH is a solvent-soluble terpolymer of vinyl acetate, vinyl chloride and vinyl alcohol sold by Union Carbide, Gasil EBN and Syloid 244 are brands of silica particles sold by Crosfield and Grace respectively, and Diakon MG102 is a polymethylmethacrylate sold by ICI).

The backcoat composition was prepared as three solutions, these being thermoset precursor, antistatic solution and filler dispersion. Shortly before use, the three solutions were mixed to give the above composition. This was then machine coated onto the etched surface, dried and cured to form a 1.5–2 μm thick backcoat.

For the receiver side of the substrate, a conductive undercoat composition was prepared consisting of:

| | | |
|---|---|---|
| methanol | | (solvent) |
| PVP K90 | 20 | parts by weight |
| Cymel 303 | 40 | " |
| K-Flex 188 | 5 | " |
| Digol | 15 | " |
| PTSA | 20 | " |

-continued

| | | |
|---|---|---|
| $LiOH.H_2O$ | 3.2 | " |

(K-Flex is a polyester polyol sold by King Industries and PVP is polyvinyl pyrrolidone, both being added to adjust the coating properties.)

This composition was prepared initially as three separate solutions of the reactive ingredients, and mixing these shortly before use. This composition was machine coated onto the opposite side of the substrate from the backcoat, dried and cured at 110° C. to give a dry coat thickness of about 1 μm.

The receiver layer coating composition also used Cymel 303 and an acid catalysed system compatible with the conductive undercoat, and consisted of:

| | | |
|---|---|---|
| toluene/MEK | 60/40 | solvent mixture |
| Vylon 200 | 100 | parts by weight |
| Tegomer HSi 2210 | 1.3 | " |
| Cymel 303 | 1.8 | " |
| Tinuvin 900 | 2.0 | " |
| Nacure 2530 | 0.2 | " |

(Tegomer HSi 2210 is a bis-hydroxyalkyl polydimethylsiloxane, cross-linkable by the Cymel 303 under acid conditions to provide a release system effective during printing, being sold by Th Goldschmidt.)

This coating composition was made (as before) by mixing three functional solutions, one containing the dye-receptive Vylon and the Tinuvin UV absorber, a second containing the Cymel cross linking agent, and the third containing both the Tegomer silicone release agent and the Nacure solution to catalyse the crosslinking polymerisation between the Tegomer and Cymel materials. Using in-line machine coating, the receiver composition was coated onto the conductive undercoat, dried and cured 140° C. to give a dye-receptive layer about 4 μm thick.

Examination of the coated web showed that the highly cross-linked backcoat had proved stable to the solvents and elevated temperatures used during the subsequent provision of the other two coatings. The web of coated film was then chopped into individual receiver sheets, and stacked and packaged for use in a thermal transfer printer. During these handling trials, and during normal printing, the sheets were found to side easily, one over another, and to feed through the printer without any observed misfeeding of the sheet. The receiver sheets were clear and transparent before printing, which properties were retained during printing to give high quality transparencies for overhead projection, with no evidence of total transfer having occurred during printing.

The surface resistivities were measured on both sides of the receiver sheet, at 20° C. and 50% humidity. Values of about $1\times10^{11}$ Ω/square were obtained on the backcoat, and values of about $1\times10^{12}$ Ω/square on the surface of the receiver coat.

EXAMPLE 2

The above Example was repeated using an opaque white substrate of Melinex 990 biaxially orientated polyester film (ICI). A backcoat was first applied followed by a conductive undercoat, both of these having the same composition as in Example 1. The receiver coat composition was modified, however, this being:

| | | |
|---|---|---|
| toluene/MEK | 60/40 | solvent mixture |
| Vylon 200 | 100 | parts by weight |
| Tegomer HSi 2210 | 0.7 | " |
| Cymel 303 | 1.4 | " |
| Tinuvin 900 | 1.0 | " |
| Nacure 2530 | 0.2 | " |

The receiver sheets had the same good handling characteristics as the transparencies of Example 1, and again there was no evidence of any total transfer occurring during printing.

EXAMPLE 3

The above Example was repeated using as the dye-receptive polymer, a mixture of saturated polyesters having different Tg values. The receiver coat composition was:

| | | |
|---|---|---|
| toluene/MEK | 47.5/52.5 | mixed solvent |
| Vylon 103 | 50 | parts by weight |
| Vylon 200 | 50 | " |
| Tegomer HSi 2210 | 0.7 | " |
| Cymel 303 | 1.4 | " |
| Tinuvin 900 | 1.0 | " |
| Nacure 2530 | 0.2 | " |

The receiver sheets had the same good handling characteristics as those of Example 2, and again there was no evidence of any total transfer occurring during printing.

EXAMPLE 4

Two further receiver sheets were prepared with a configuration essentially as shown in FIG. 1, with different receiver coats. One of these (Example 4) has a receiver coat according to the present invention, containing an acid cured silicone/Cymel release system, while the other, labelled here as Comparison A, has a base cured silicone/epoxide release system, and is thus outside the present invention.

The conductive undercoat in both cases comprised

| | | |
|---|---|---|
| Cymel 303 | 1.51 | parts by weight |
| diethylene glycol | 0.57 | " |
| lithium PTSA | 0.57 | " |
| PTSA | 0.19 | " |

The receptive layer of Example 4 also used Cymel 303 as cross linking agent for the silicone, and the coating solution was made by mixing three solutions as follows:

| | | | |
|---|---|---|---|
| A. | toluene/MEK | 60/35 | mixed solvent |
| | Vylon 200 | 14.8 | parts by weight |
| | Tinuvin 234 | 0.15 | " |
| B. | MEK | 2.5 | |
| | Cymel 303 | 0.12 | " |
| C. | MEK | 2.5 | |
| | Tegomer H—Si 2210 | 0.024 | " |
| | Nacure 2530 | 0.15 | " |

For Comparison A, the receiver coat was prepared from the following solutions

| | | | |
|---|---|---|---|
| A. | toluene/MEK | 53/36 | solvent mixture |
| | Vitel PE 200 | 12 | parts by weight |
| | Atlac 363E | 0.60 | " |
| | aminosiloxane M468 | 0.51 | " |

-continued

| | | | |
|---|---|---|---|
| B. | toluene/MEK | 50/50 | solvent mixture |
| | Imidrol OC | 0.12 | parts by weight |
| | stearic acid | 0.09 | " |
| C. | toluene | | solvent |
| | Degacure K126 | 0.09 | parts by weight |

(Vitel PE 200 is a saturated polyester sold by Goodyear, Atlac 363E is an unsaturated polyester, aminosiloxane M468 is an amino-modified silicone sold by ICI, Imidrol is a wetting agent, and Degacure K126, sold by Degussa, is an organic oligoepoxide which is used here for crosslinking the siloxane.)

For each receiver coat composition, solutions A and B were prepared separately and filtered, and the catalyst solution C was mixed into the filtered solution shortly before the coating composition was applied over the conductive undercoat. After coating and curing, the receiver coats had a dry thickness of about 2 μm.

Thermal transfer prints were made using standard dyesheets, and no total transfer was observed. Both receiver sheets handled well, both before and after printing. The receiver coat of Example 3 appeared to have a stronger bond to the conductive undercoat than that of Comparison A.

EXAMPLE 5

A further receiver sheet was prepared in which the dielectric substrates were replaced by paper, and the conducting undercoats and backcoats of the previous examples were omitted. The substrate was Chromolux 700, a 135 g/m$^2$, high gloss, white cast coated paper made by Zanders. This was coated with a receiver coat composition essentially as specified above in Example 2, i.e.

| | | |
|---|---|---|
| toluene/MEK | 60/40 | solvent mixture |
| Vylon 200 | 100 | parts by weight |
| Tegomer HSi 2210 | 0.7 | " |
| Cymel 303 | 1.4 | " |
| Tinuvin 900 | 1.0 | " |
| Nacure 2530 | 0.2 | " |

The receiver sheets had the same good handling characteristics as the receiver of Example 2, despite the absence of any conducting undercoat or backcoat. Again, no total transfer was experienced during printing.

We claim:

1. A receiver sheet for dye-diffusion thermal transfer printing, comprising a sheet-like substrate supporting a receiver coat consisting essentially of a dye-receptive polymer composition doped with a release system, characterised in that the release system comprises a thermoset reaction product of at least one silicone having a plurality of hydroxyl groups per molecule and at least one organic polyfunctional N-(alkoxymethyl) amine resin reactive with such hydroxyl groups under acid catalysed conditions.

2. A receiver sheet as claimed in claim 1, characterised in that the amine resin has its polyfunctionality provided by having at least three alkoxymethyl groups per molecule which are available to react with the hydroxyl groups.

3. A receiver sheet as claimed in claim 2, characterised in that the amine resin is selected from N-(alkoxymethyl) derivatives of urea, guanamine and melamine resins.

4. A receiver sheet as claimed in claim 3, characterised in that the amine resin is a hexamethoxymethylmelamine or oligomer thereof.

5. A receiver sheet as claimed in claim 1, characterised in that the silicone content of the release system is present in an amount within the range 0.16–5% by weight of the dye-receptive polymer.

6. A receiver sheet as claimed in claim 5, characterised in that the amine resin is present in amount within the range 1–2 equivalents of the silicone.

7. A receiver sheet as claimed in claim 1, characterised in that the receiver sheet has an antistatic treatment on both sides of the substrate, the antistatic treatment on the side supporting the receiver coat comprising a conductive undercoat located between the substrate and the receiver coat.

8. A receiver sheet as claimed in claim 7, characterised in that the conductive undercoat comprises a cross-linked organic polymer containing a plurality of ether linkages doped with an alkali metal salt to provide conductivity.

9. A receiver sheet as claimed in claim 8, characterised in that the cross-linking agent used in the conductive undercoat is essentially the same as that of the receptive layer.

10. A stack of print size portions of a receiver sheet according to any one of the preceding claims, packaged for use in a thermal transfer printer.

* * * * *